United States Patent [19]

Hill

[11] 4,087,949

[45] May 9, 1978

[54] BUILDING OF IMPROVED CARDBOARD PANEL CONSTRUCTION

[76] Inventor: Donald E. Hill, 2308 Meadowvale Dr., NE., Atlanta, Ga. 30345

[21] Appl. No.: 754,533

[22] Filed: Dec. 27, 1976

[51] Int. Cl.[2] ..... E04C 1/00

[52] U.S. Cl. ..... 52/309.13; 52/92; 52/631

[58] Field of Search ..... 52/90, 92, 93, 309.13, 52/309.14, 631

[56] References Cited

U.S. PATENT DOCUMENTS

| | | | |
|---|---|---|---|
| 3,169,347 | 2/1965 | Shy, Jr. | 52/92 |
| 3,423,898 | 1/1969 | Tracy et al. | 52/92 X |
| 3,747,290 | 7/1973 | Barrell et al. | 52/90 |
| 3,798,852 | 3/1974 | Nicoll, Jr. | 52/90 |
| 3,800,485 | 4/1974 | Yates | 52/90 |
| 3,803,786 | 4/1974 | Schneider | 52/90 X |

*Primary Examiner*—Ernest R. Purser
*Assistant Examiner*—Carl D. Friedman
*Attorney, Agent, or Firm*—Robert B. Kennedy

[57] ABSTRACT

A building comprising a cardboard wall panel having a vertical, generally planar central section overlaid with a layer of fiberglass having tensile strength of a preselected magnitude from which two vertical side sections depend at substantially right angles. The building also comprises a cardboard roof panel supported above said wall panel having a generally planar central section overlaid with a layer of fiberglass having tensile strength substantially in excess of said preselected magnitude from which two vertical side sections depend.

A building comprising a fiberglass reinforced cardboard wall panel having a vertical, generally planar central section from which two vertical side sections extend at substantially right angles, and a top flap extending substantially right angularly and horizontally from an upper portion of the central section between the side sections. A fiberglass reinforced cardboard roof panel is supported along an incline extending over the wall panel and has a generally planar central section from which two vertical side sections depend. The lower edges of the two depending roof side sections are provided with a horizontal step above the wall panel. A metallic L-shaped bracket secures the roof panel in place above the wall panel.

4 Claims, 9 Drawing Figures

BUILDING OF IMPROVED CARDBOARD PANEL CONSTRUCTION

BACKGROUND OF THE INVENTION

This invention relates to buildings of the type constructed with cardboard panels.

Heretofore, as exemplified by the disclosure in U.S. Pat. No. 3,747,290, buildings have been formed with both the building walls and roof comprised of a series of cardboard panels formed from flat cardboard blanks. The blanks have been bent or folded to form a central elongated section from which two side sections extend right angularly. The top ends of the wall panels have been folded inwardly along an incline oriented perpendicularly to the slope of the mating roof panels. The lower ends of the roof panels have similarly been tucked in to fit flush against the inclined end flap members of the mating wall panels. So formed, the wall and roof panels are fastened together side by side to form the building walls and roof. To impart structural integrity to the assembled walls and roof conventional wooden trusses, studs, collar members, joists, gussets and beams are mounted to each of the roof and wall panels. The siding and joined sections are preferably coated with fiberglass for reinforcement and weather resistance.

Although buildings of the structure just described formed of a plurality of cardboard panels have offered obvious savings in the cost of building materials, they have yet to meet with significant commercial success. The design details of the wall and roof panels have had to be relatively complex to assure a mutually flush mounting of the roof and wall panel member ends. Each time the slope of the roof is altered for aesthetic or climatic reasons, both the roof and wall panel ends must ordinarily be redesigned to accommodate for such. The necessity for wooden structural members mounted to each panel has substantially mitigated the very savings in construction material costs that these type of buildings have sought to achieve through use of cardboard. Where the entire panels have been coated with fiberglass a flush fit between adjoining panels has been difficult to achieve due to irregularities in the fiberglass surface. Differentials in needed roof and wall panel strengths has also failed to be solved in an efficient and economic manner.

Accordingly, it is a general object of the present invention to provide an improved building formed of cardboard panels.

Another general object of the invention is to provide an improved panel member for a building of the type described.

More specifically, it is the object of the present invention to provide a building of the type described having minimal need for internal support structures such as joists, gussets, trusses, studs, collars and beams.

Another object of the invention is to provide a building of the type described having improved structural simplicity and economy.

Another object of the invention is to provide a building of the type described in which the roof overhangs the walls to inhibit rainwater from draining from the roof directly onto the walls.

Yet another object of the invention is to provide a building of the type described in which the roof and wall panels are of substantially similar shape and construction but with the roof panels having substantially greater tensile strength than the wall panels.

Still another object of the invention is to provide roof and wall panels of the type described that are selectively coated with reinforcing fiberglass while yet retaining substantially uniform thickness.

SUMMARY OF THE INVENTION

In one form of the invention a building is provided comprising a fiberglass reinforced cardboard wall panel having a vertical, generally planar central section from which two vertical side sections extend at substantially right angles. A fiberglass reinforced cardboard roof panel is supported above said wall panel along an incline having a generally planar central section from which two generally rectangular side sections depend and metallic bracket means are provided for holding said roof panel in place above said wall panel.

In another form of the invention a building is provided comprising a fiberglass reinforced cardboard wall panel having a vertical, generally planar central section from which two vertical side sections extend at substantially right angles, and a top flap extending substantially right angularly and horizontally from an upper portion of the central section between the side sections. The building also comprises a fiberglass reinforced cardboard roof panel supported along an incline extending over the wall panel and having a generally planar central section from which two vertical side sections depend.

In another form of the invention a building is provided comprising a cardboard wall panel having a vertical, generally planar central section overlaid with a layer of fiberglass having tensile strength of a preselected magnitude from which two vertical side sections depend at substantially right angles. The building also comprises a cardboard roof panel supported above said wall panel having a generally planar central section overlaid with a layer of fiberglass having tensile strength substantially in excess of said preselected magnitude from which two vertical side sections depend.

In yet another form of the invention a building is provided comprising a fiberglass reinforced cardboard wall panel having a vertical, generally planar central section from which two vertical side sections extend at substantially right angles. A fiberglass reinforced cardboard roof panel is supported above the wall panel along an incline having a generally planar central section from which two generally rectangular side sections depend. The lower edges of the depending rectangular roof panel side sections have a generally horizontal edge segment supported above the wall panel which merges with at least one inclined edge segment extending aside the wall panel.

DESCRIPTION OF THE PREFERRED EMBODIMENT

Figure 1:
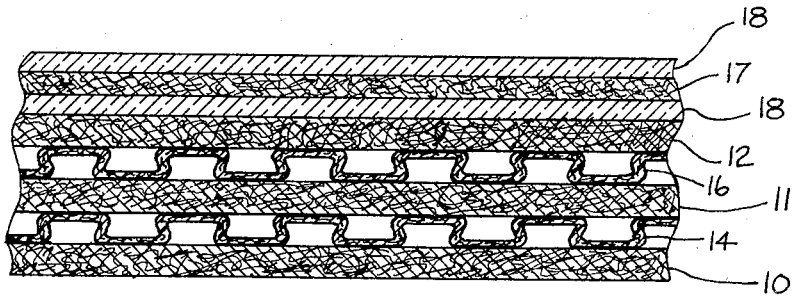
FIG. 1 is a cross-sectional view of a fiberglass reinforced cardboard panel which may be used in practicing the present invention.

Referring now in more detail to the drawing there is shown in FIG. 1 a sectional view of a fiberglass reinforced cardboard panel of conventional construction which may be used in practicing the invention. The panel is seen to include a basic board comprising three mutually spaced, generally planar layers of cardboard 10, 11 and 12 between which are compressibly sandwiched two layers of corrugated cardboard 14 and 16. Preferably, the configuration of the basic board is B/C flute compound of 90 lb. liner, 33 lb. medium, 90 lb. center liner, 33 lb. medium and 90 lb. liner with a mullen of 600 lbs. The medium is of non-wicking quality all combined with waterproof adhesive.

Atop cardboard layer 12 is coated a layer of fiberglass which includes a fibrous layer 17 impregnated with and bounded by resin 18. Preferably, the cardboard is 5/16 inches thick and the fiberglass is ⅛ inches thick. As will hereinafter be described, the fiberglass may be of various tensile strengths without an appreciable change in fiberglass thickness. This is achieved principally through the structural arrangement of the fibrous layer 17. For relatively weak fiberglass the fibrous layer may be constructed of chopped strand mat while for stronger fiberglass layer 17 may be a woven roving. Exemplary of available resins is No. 58187 sold by PPG Industries, No. 4151A sold by American Cyanamid and No. 12200 sold by W. R. Grace Company. The chopped strand mat may be No. M-700 sold by Owens-Corning Fiberglass Company weighing 1½ ounces per square foot while the woven roving may be Marco Mat No. MM249 sold by Polyester Division Hatco weighing 4.17 ounces per square foot.

Figure 2:
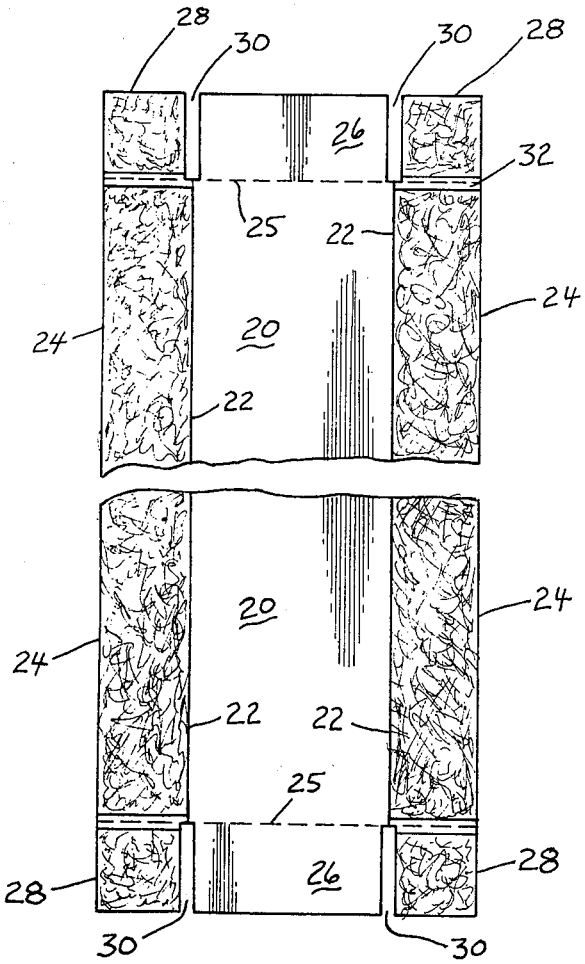
FIG. 2 is a plan view of the inside principal surface of a cardboard panel blank embodying principles of the invention for use as a side wall building panel member.

With reference next to FIG. 2, the inside principal surface of a cardboard blank adapted for use as a side wall panel is shown. Preferably, this panel is of the general fiberglass reinforced compressible cardboard structure shown in FIG. 1. The panel is seen to include an elongated central section 20 bounded at the sides by two score lines 22. Laterally aside the score lines are unitarily formed two side sections 24. Each end of the central and side sections is bounded by a transverse score line 25. A central end flap 26 is located beyond the score line bounding the central section while two side end flaps 28 are located beyond the score lines bounding the side sections 24. Slots 30 spacially separate central end flaps 26 from side section end flaps 28. These slots extend from the edges of the flaps to the score lines 25.

The central section and central end flap surfaces are seen to be cardboard while the surfaces of the side sections 24 and side section end flaps 28 are seen to be fiberglass. It will be noted that the fiberglass layers are discontinuous immediately over the score lines 25 between the side sections and side section end flaps to facilitate folding of the end flaps along the score line. The presence of slots 30 facilitates relative movement between the central and side end flaps whereby the side end flaps may be positioned underlaying or overlaying the central end flap.

Figure 3:
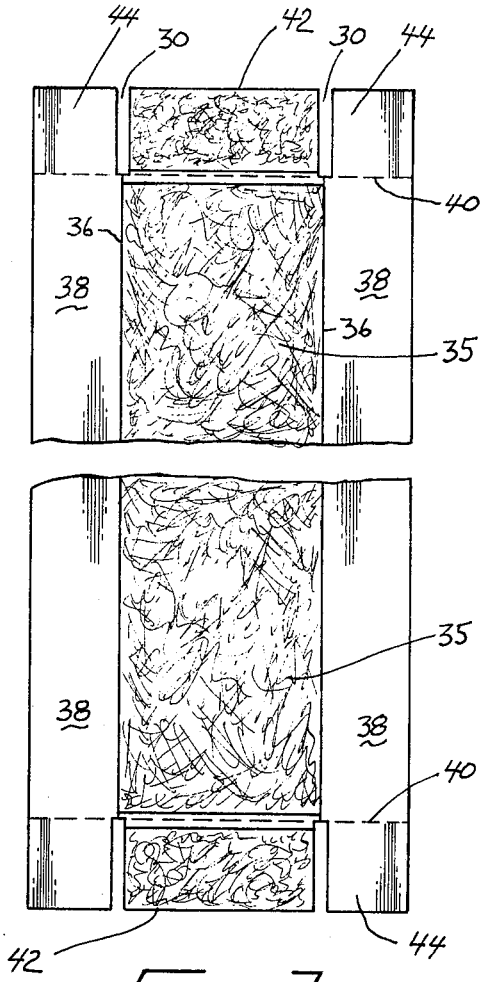
FIG. 3 is a plan view of the other, inside principal surface of the cardboard panel blank shown in FIG. 2.

In FIG. 3 the surface opposite the panel blank surface shown in FIG. 2 is seen again to include an elongated central section 35 bounded by two score lines 36 beyond which are located two elongated side sections 38. The end of both the central and side sections is marked by score lines 40 beyond which are located central section end flaps 42 and side section end flaps 44 mutually separated by slots 30. The side sections and side section end flaps here on this side are seen to be uncoated with fiberglass and thus have a cardboard surface while the central section and the central section end flaps are seen to be coated with fiberglass.

Figure 4:
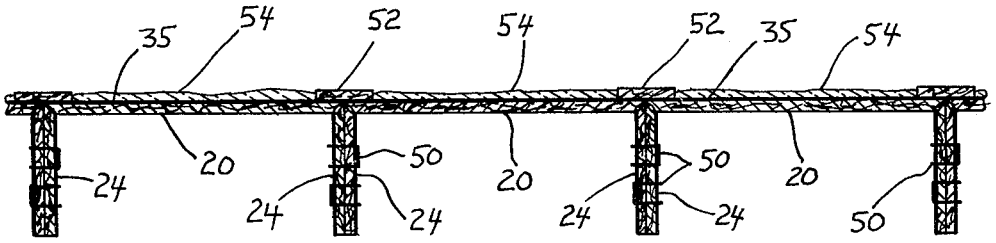
FIG. 4 is a horizontal cross-sectional view of a portion of a building wall formed by a plurality of the side wall panels formed from the blanks shown in FIGS. 2 and 3.

With reference next to FIG. 4 an assemblage is shown of side panels formed from the blanks just described into a building wall. The panel side sections 24 are seen to be folded right angularly from the center sections 20 whereby the fiberglass coated surfaces on the side sections face one another and the cardboard side sections 38 of adjacent panels are positioned flush against one another and secured together by staples 50. Vertical strips of fiberglass 52 are then adhered to the outside of adjacent panels overlaying their vertical junctures. A cementious gel coating 54 is then applied to the outside of the panels as additional weathering protection.

Figure 5:
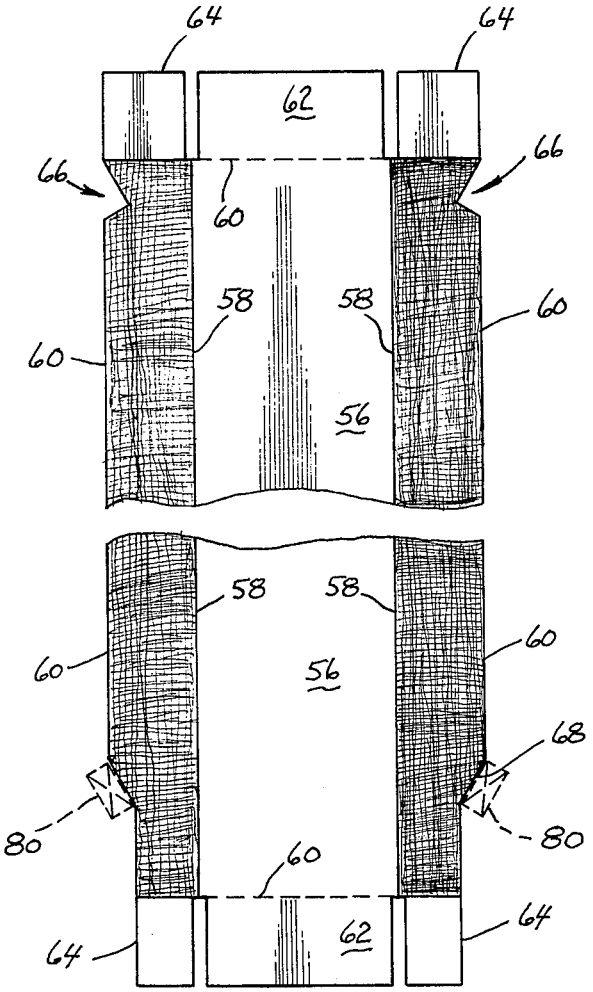
FIG. 5 is a plan view of the underside principal surface of a cardboard panel for use as a building roof panel member embodying principles of the invention.

With reference next to FIG. 5 the underside of a roof panel blank is seen similarly to comprise an elongated central section 56 bounded by two parallel score lines 58 and a transverse score line 60 along the ends thereof. The surface of the center section is naked cardboard. The center section is straddled by two elongated side sections 60 which are coated with a layer of fiberglass having greater tensile strength than that of the wall panel fiberglass. Preferably, the roof panel fiberglass comprises woven roving while that of the side wall panels comprises chopped strand mat. These materials are readily available, commercially.

The roof panels are provided with central end flaps 62 formed as unitary extensions of central section 56. Side flaps 64 are similarly formed as unitary extensions of the side sections 60. The underside, principal surface of all the end flaps here are uncoated and thus are of cardboard composition. A notch 66 is formed in the side edge of the two side sections 60 adjacent the side end flap 64 along the top of the wall panel while the side edge of the side sections adjacent the lower end are formed with an inclined step or notch 68 for purposes hereinafter to be explained.

Figure 6:
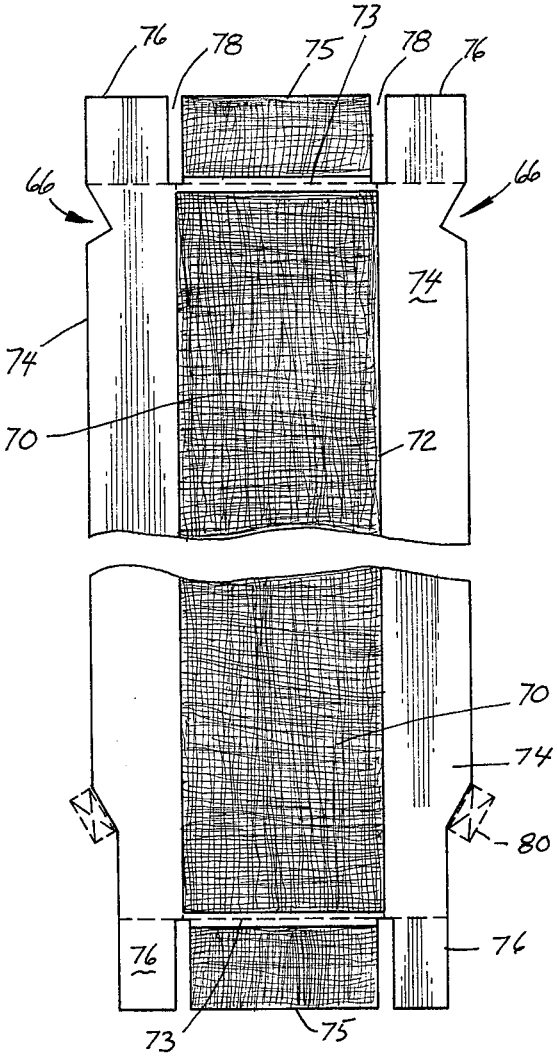
FIG. 6 is a plan view of the other, outside principal surface of the cardboard blank shown in FIG. 5.

With reference next to FIG. 6 the other side of the roof panel shown in FIG. 5 is seen again to include a central section 70 bounded by two score lines 72 along the sides thereof and a transverse score line 73 along the ends. Laterally aside the score lines 73 are two side sections 74. Again, the panel has central end flaps 75 disposed between side end flaps 76. Slots 78 extend from the ends of the end flaps to the transverse score lines 73 between the central and side end flaps. This principal surface of the roof panel is also seen to be coated with a relatively weaker layer of fiberglass, such as chopped mat, as are central end sections 75 while the side section and the end flaps are not coated. Again, the transverse score lines 73 are not coated with fiberglass to facilitate folding.

Figure 7:
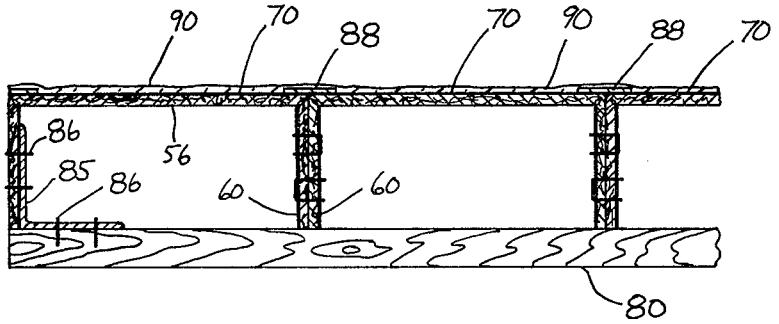
FIG. 7 is an inclined side view, in cross-section, of a portion of a roof formed by a plurality of the roof panels formed from the blanks shown in FIGS. 5 and 6.
Figure 8:
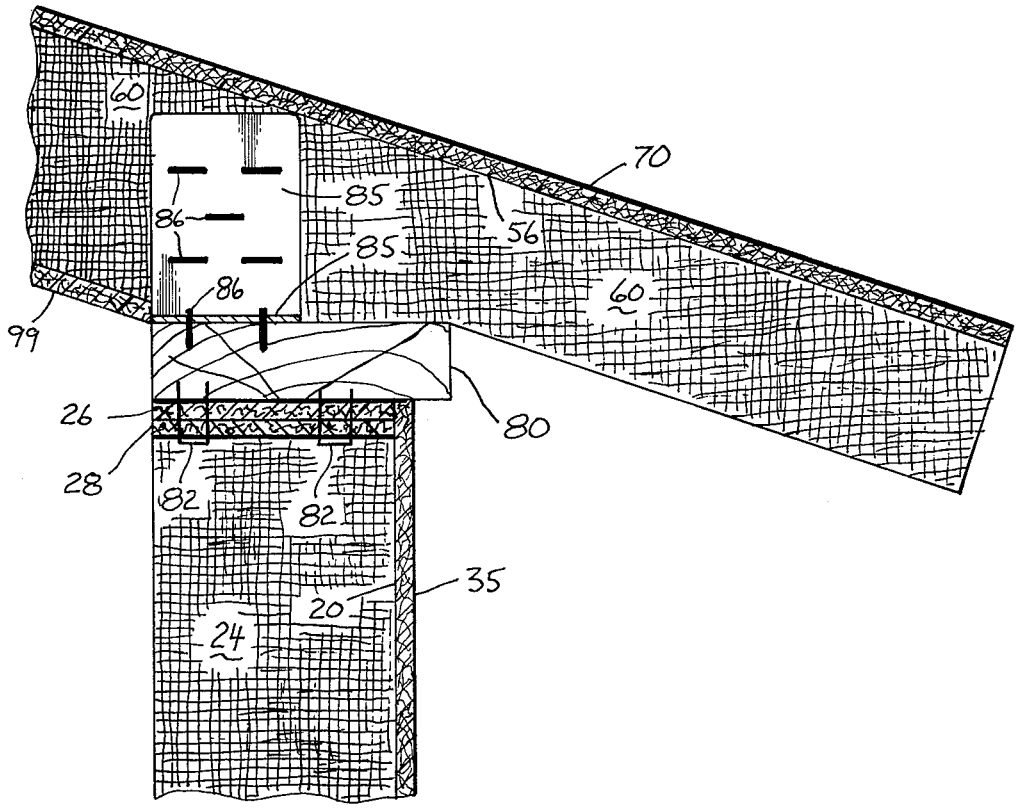
FIG. 8 is a transverse cross-sectional view of the junction of roof panels as shown in FIG. 7 and wall panels as shown in FIG. 4.

With reference next to FIGS. 7 and 8, the junction and mounting of a roof panel atop a side panel is shown. Here the side panel side section end flaps 28 are seen to be folded beneath and flush against the side panel central section end flap 26. One or more wooden planks 80 is mounted flush atop the side panel central end flap and secured thereto by means of staples 82. A roof panel is mounted atop plank 80 with its side sections 60 depending downwardly at right angles to central section 56. The roof panel is positioned with step 68 in horizontal abutment with the top surface of the plank. A 26-gauge galvanized steel L-shaped bracket 85 measuring 4 inches width and 5½ inches length each leg is mounted to an inside roof panel side section 60 and to the top surface of plank 80 by stapeles 86. Although only one wall panel is shown here, it should be understood that the side sections of adjacent side wall panels are secured together forming the side wall shown in FIG. 4. Again strips of fiberglass 88 overlay the outside surface juncture of adjacent roof panels and the entire outside surface of the roof is coated with a gel 90 for weather resistance.

Figure 9:
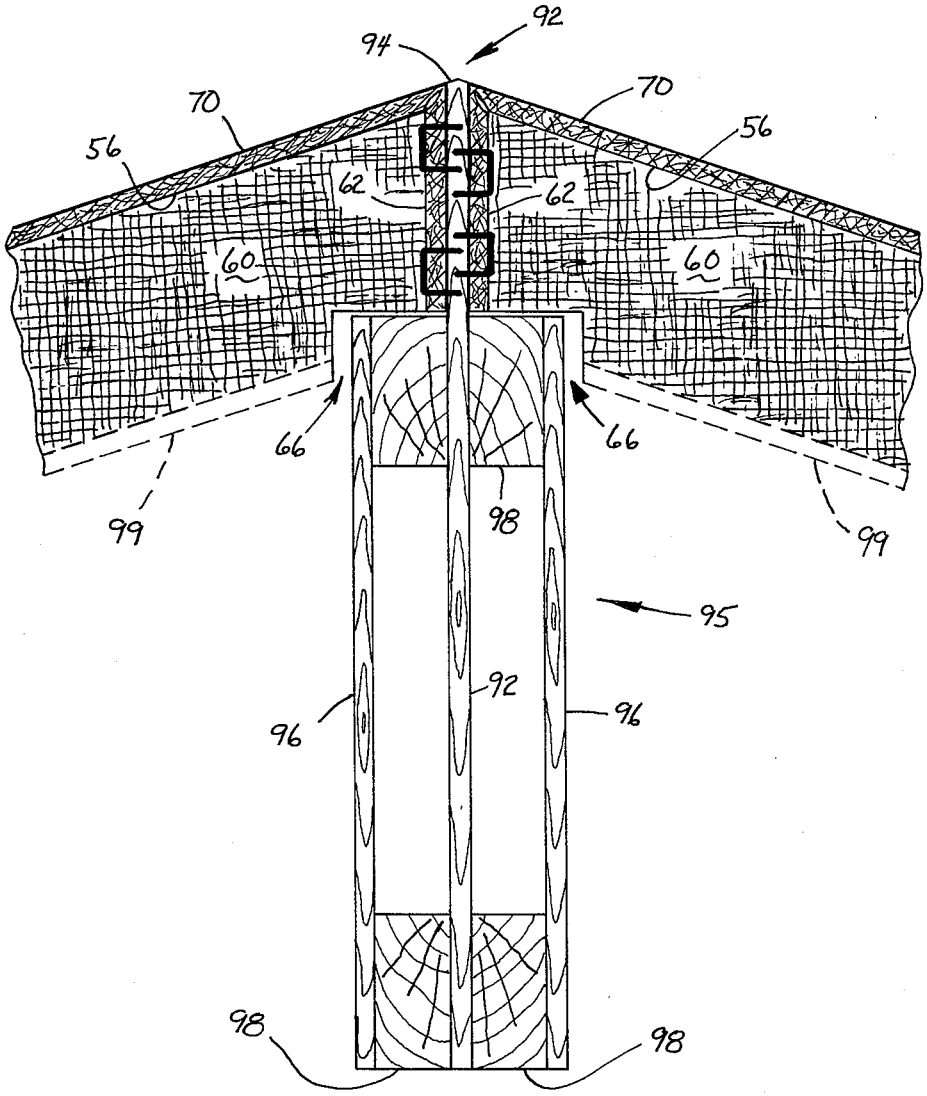
FIG. 9 is a cross-sectional view of the apex junction of two roof panels in a building embodying principles of the invention.

With reference next to FIG. 9 the apex 92 of the building is seen to be formed by a central ⅜ inch plywood leg member 94 of a composite wooden beam 95 that includes two outer leg members 96 also ⅜ inch plywood, mounted to the side of the central members by four wooden 2 × 4 inch boards 98. The roof panels are mounted with central section end flaps 62 stapled flush against the sides of the beam central member 94. The wooden beam resides within two opposed notches 66 in the roof panel side sections. A ceiling 99 is preferably mounted in conventional fashion to the bottom edge of the depending side sections of the roof panels which effectively provide rafters for the building.

The remaining portions of the building, including the provisions of windows and doors, may be of conventional structure. Preferably, the building is constructed atop a concrete slab or the like with the lower end flaps 42 and 44 of the side wall panels folded to a mutually overlaying position and stapled atop one or more wooden boards. The presence of the metal L-shaped brackets, in conjunction with the other described structural features has been found to eliminate the need for wooden trusses, gussets, beams and the like thereby effecting a significant savings in cost of construction. The use of fiberglass of one tensile strength on the wall panels in conjunction with the use of fiberglass of substantially greater tensile strength on the roof panel provides an excellent balance between the need for load supporting strength of the roof and overall weight and costs. In one series of tests, for example, individual roof panels were found to sustain 1606 lb.-ft. ultimate moment, a tensile stress ultimate moment of 722.4 lbs. per inch, and ultimate compressive stress of 354.7 lbs. per inch. The configuration of the various panel members is simple and yet permits the mounting of roof panels atop the side wall panels with an overhang whereby rain water does not flow off the roof directly onto the building side. The selective coating of each panel member itself, in addition to the selection between roof and wall panel members, is found to provide the required reinforcement of the members while permitting a very smooth, flush abutment between adjoining panel members with only their cardboard surfaces pressed together. Though selectively coated, it should be realized that the thickness of the panels remain substantially uniform thereby facilitating storage and weight distribution. Since the corrugated layers of the cardboard itself permit compression, once adjacent members have been stapled with their fiberglass layers facing outward, some compression of the adjoining members can be effected thereby creating a very snug and well insulated fitting between adjacent panels. The on-site assembly is also seen to be greatly facilitated due to the simplicity of construction. Once the adjacent wall panels are stapled together, a continuous wooden board may be mounted atop an assemblage of the side panels and then the roof panels mounted one by one thereatop. Where feasible, the wooden plank may be eliminated and the roof members mounted directly atop the side panels, although such is not preferred. The combination of the metal brackets in conjunction with the central beam under the apex of the building provides an overall simple yet structurally sound building.

It should be understood that the just described embodiments merely illustrate principles of the invention in selected forms. Many modifications, additions and deletions may, of course, be made thereto without departure from the spirit and scope of the invention as set forth in the following claims.

I claim:

1. A building comprising cardboard wall panels having a vertical, generally planar central section overlaid on the outside with a layer of fiberglass having tensile strength of a preselected magnitude from which central section two vertical side sections extend at substantially right angles to present two mutually confronting wall panel surfaces; and cardboard roof panels supported above said wall panels having a generally planar central section overlaid with a layer of fiberglass having tensile strength substantially in excess of said preselected magnitude from which central section two vertical side sections depend, to present two mutually confronting roof panel surfaces; and wherein the confronting surfaces of said wall panel vertical side sections are overlaid with layers of fiberglass having tensil strength approximating said preselected magnitude.

2. A building comprising cardboard wall panels having a vertical, generally planar central section overlaid with a layer of fiberglass having tensile strength of a preselected magnitude from which central section two vertical side sections extend at substantially right angles to present two mutually confronting wall panel surfaces; and cardboard roof panels supported above said wall panels having a generally planar central upper section overlaid with a layer of fiberglass having tensile strength substantially in excess of said preselected magnitude from which central section two vertical side sections depend, to present two mutually confronting roof panel surfaces, and; wherein the confronting surfaces of said roof panel vertical side sections are overlaid with layers of fiberglass having tensile strength approximating that of the layers of fiberglass overlaying said roof panel central section.

3. A building comprising cardboard wall panels having a vertical, generally planar central section overlaid with a layer of fiberglass having tensile strength of a preselected magnitude from which central section two vertical side sections extend at substantially right angles to present two mutually confronting wall panel surfaces overlaid with layers of fiberglass; and cardboard roof panels supported above said wall panels having a generally planar central section overlaid with a layer of fiberglass having tensile strength substantially in excess of said preselected magnitude from which central section two vertical side sections depend to present two mutually confronting roof panel surfaces overlaid with layers of fiberglass, and wherein the surface of said wall panel generally planar central section facing away from said wall panel side section is overlaid with said layer of fiberglass having tensile strength of said preselected magnitude.

4. A building comprising cardboard wall panels having a vertical, generally planar central section overlaid with a layer of fiberglass having tensile strength of a preselected magnitude from which central section two vertical side sections extend at substantially right angles to present two mutually confronting wall panel surfaces; and cardboard roof panels supported above said wall panels having a generally planar central section overlaid with a layer of fiberglass having tensile strength substantially in excess of said preselected magnitude from which central section two vertical side sections depend to present two mutually confronting roof panel surfaces overlaid with layers of fiberglass, and wherein the upper surface of said roof panel generally planar central section is overlaid with said layer of fiberglass having said tensile strength in excess of said preselected magnitude.

* * * * *